United States Patent [19]

Timms et al.

[11] Patent Number: 4,589,395

[45] Date of Patent: May 20, 1986

[54] FUEL SYSTEM FOR INTERNAL COMBUSTION ENGINES

[75] Inventors: Colin T. Timms, Harrow Weald; James H. Garrod, London, both of England

[73] Assignee: Lucas Industries public limited company, Brimingham, England

[21] Appl. No.: 560,511

[22] Filed: Dec. 12, 1983

[30] Foreign Application Priority Data

Dec. 24, 1982 [GB] United Kingdom ..... 8236748

[51] Int. Cl.[4] ..... F02M 29/00

[52] U.S. Cl. ..... 123/516; 123/179 L; 123/514

[58] Field of Search ..... 123/516, 514, 179 L, 123/198 DB, 198 D, 446

[56] References Cited

U.S. PATENT DOCUMENTS

| | | | |
|---|---|---|---|
| 2,297,238 | 9/1942 | Neugebauer | 123/516 |
| 4,279,232 | 7/1981 | Schuster | 123/516 |
| 4,450,820 | 5/1984 | Haynes | 123/516 |

FOREIGN PATENT DOCUMENTS

| | | | |
|---|---|---|---|
| 2430636 | 6/1975 | Fed. Rep. of Germany | 123/514 |
| 733809 | 10/1932 | France | 123/516 |
| 2044399 | 10/1980 | United Kingdom | 123/514 |

*Primary Examiner*—Carl Stuart Miller

[57] ABSTRACT

A fuel system for an internal combustion engine includes a pumping apparatus having a high pressure pump to which fuel is supplied by a low pressure pump. The low pressure pump draws fuel through a filter unit from a fuel tank. A reservoir chamber is provided above the apparatus and this in use is replenished with fuel through an inlet. The chamber has a restricted outlet communicating with the fuel inlet of the pumping apparatus. In the event that air is drawn into the system in sufficient quantity to stop the engine as for example if the fuel tank is drained of fuel, the fuel in the reservoir chamber flows through the restricted outlet to the fuel inlet of the apparatus to enable the engine to be restarted quickly.

5 Claims, 3 Drawing Figures

FUEL SYSTEM FOR INTERNAL COMBUSTION ENGINES

This invention relates to fuel systems for internal combustion engines and of the kind comprising a fuel pumping apparatus incorporating high and low pressure pumps and a fuel filter unit through which fuel is drawn by the low pressure pump from a fuel supply tank, the fuel being supplied by the low pressure pump to the high pressure pump.

When such systems are in use the low pressure pump draws fuel from the fuel tank by way of the filter unit and supplies the fuel at a regulated pressure to the high pressure pump. The high pressure pump supplies fuel in timed relationship to an associated engine. The apparatus will incorporate venting arrangements to deal with small quantities of air which may enter the fuel system in the normal use of the system and such small quantities of air will be vented without having any noticeable effect upon the operation of the apparatus. This is mainly due to the fact that the low pressure pump is designed so that it delivers fuel at a rate which is in excess of the maximum rate of fuel supply to the engine. A problem arises however if large quantities of air enter the system such for example if the fuel becomes exhausted or if the filter unit is serviced.

In this situation the engine must be cranked for an extended period in order to draw fuel through the system and this imposes a severe load upon the starting motor of the engine and the associated electrical system. There are a number of ways in which the cranking period can be reduced. For example, it is possible to increase the displacement of the low pressure pump. This has the disadvantage that during normal operation of the apparatus the rate of fuel delivery is much higher than is required and this leads to unnecessary heating and aeration of the fuel as well as an additional, power loss.

An alternative arrangement is to provide an additional pump such as a diaphragm pump operated by the engine and incorporating a hand primer, or an electrically operated pump. Both these forms of additional pump enable the system to be purged of air before an attempt is made to start the engine. The provision of either form of pump involves additional expense both in terms of the pump itself and also in terms of the cost of installation. Another arrangement is to provide a hand operated pump on the filter unit. This solution enables the system to be primed before an attempt is made to start the engine and it can be embodied in the design of the filter unit. However, since it does not act as a pump during normal operation of the fuel system, the non-return valves which must be incorporated into the design of the hand operated pump create pressure drops which may hinder the normal operation of the system.

The object of the present invention is to provide a fuel system for an internal combustion engine in a simple and convenient form.

According to the invention a fuel system of the kind specified comprises a fuel reservoir chamber disposed in use, above the pumping apparatus, said chamber having a restricted outlet in communication with the inlet of the low pressure pump and means for maintaining said chamber full of fuel during the use of the apparatus.

A fuel system in accordance with the invention will now be described with reference to the accompanying drawings in which.

Figure 1:
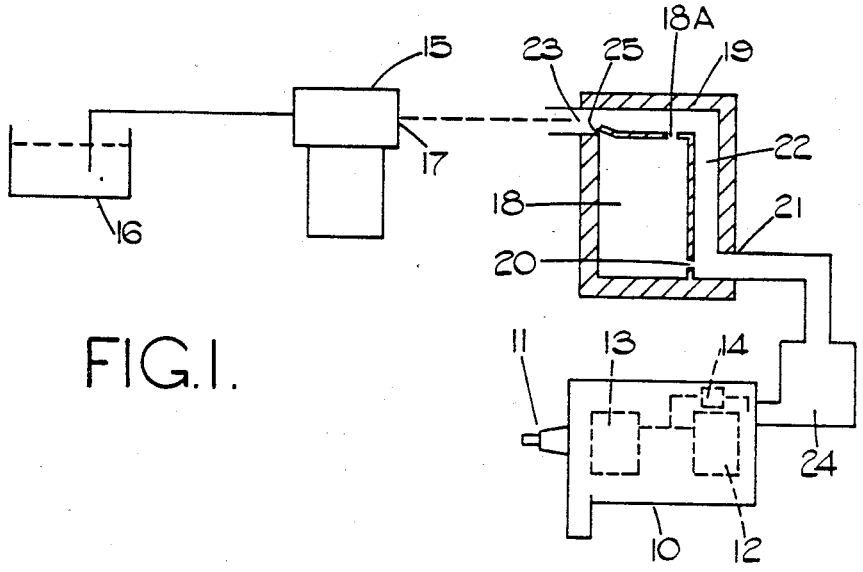
FIG. 1 is a diagrammatic representation of the fuel system.

Referring to FIG. 1 of the drawings the fuel system comprises a fuel pumping apparatus generally indicated at 10 having a drive shaft 11 for connection to a rotary part of the engine so that the apparatus is driven in timed relationship with the engine. The apparatus incorporates a low pressure pump indicated in outline at 12 and a high pressure pump indicated in outline at 13. The low pressure pump delivers fuel to the high pressure pump and this in turn delivers fuel at high pressure in timed relationship, to the injection nozzles respectively of the associated engine. The output pressure of the low pressure pump is controlled by a relief valve 14.

The fuel system also includes a fuel filter unit 15 having an inlet connection to a supply tank 16 and an outlet connection indicated at 17. The fuel system also includes a first chamber 18 defined in a body 19, the body having a mounting so that in use, the chamber 18 is disposed above the pumping apparatus 10. The chamber 18 has a restricted outlet 20 from the lower portion of the chamber and this is disposed adjacent an outlet 21 in the body. The outlet 21 is connected by way of a passage 22 with an inlet 23 in the upper portion of the body, the inlet 23 being connected to the outlet 17 of the filter unit. The chamber 18 has an air vent 18A in its upper wall the vent opening into the passage 22.

The outlet 21 is connected to a fuel inlet of the apparatus 10, this inlet communicating directly with the inlet of the low pressure pump 12. Conveniently a second chamber 24 is provided between the outlet 21 and the inlet of the fuel pumping apparatus.

The first chamber is provided with an inlet 25 at its upper end, the inlet 25 being adjacent the inlet 23.

In operation, and considering firstly that the system is primed with fuel, the low pressure pump draws fuel through the chamber 24 from the outlet 21. Fuel flows into the inlet 23 of the body 19 from the fuel filter unit and this in turn receives fuel from the tank 16. The low pressure pump 12 serves to draw fuel through the system as described. In the normal operation of the apparatus the chamber 18 is maintained full of fuel although there will be a slight flow of fuel through the chamber, the main flow of fuel occurs through the passage 22.

If, for example, the fuel level in the tank 16 falls to below the level of the suction pipe which is connected to the inlet of the filter unit 15, air will be drawn into the filter unit and will eventually be drawn through the passage 22 and into the inlet of the low pressure pump. It is arranged that the size of the outlet 20 is insufficient to maintain the engine in operation so that the engine will stall but the chamber 18 will be substantially full of fuel. After the engine has stopped the fuel flows at a restricted rate from the chamber 18 by way of the outlet 20, into the chamber 24 and accumulates therein. Air can flow into the chamber 18 through the vent 18A and the connection between the chamber 24 and the outlet 21 is sufficiently large to allow the displaced air from the chamber 24 to return to the passage 22. If the tank 16 is replenished with fuel, the engine can be started with the low pressure pump being supplied with fuel which has accumulated in the chamber 24, from the chamber 18. As soon as the pump 12 starts to draw fuel, fuel will be drawn from the tank 16 and will flow into the filter unit and eventually will flow through the passage 22 into the chamber 24. Some air will be drawn into the low pressure pump but the apparatus incorporates an internal air venting arrangement whereby some of the air drawn into the low pressure pump can be returned to the fuel tank. Some air will pass to the high pressure pump which will therefore supply fuel and air to the engine. In this manner the cranking of the engine necessary to purge the system of air is kept to a minimum and furthermore, the low pressure pump 12 need not be of the self-priming variety since it will have a supply of fuel available for starting purposes.

Figure 2:
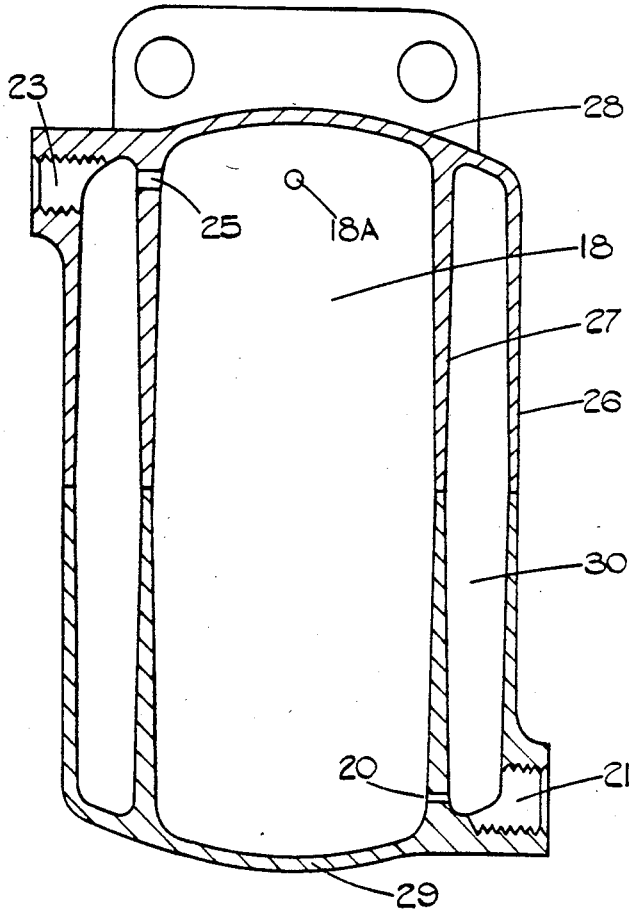
FIG. 2 shows an example of one part of the system seen in FIG. 1.

FIG. 2 shows one construction of body 19 together with the associated chambers. As shown in FIG. 2, outer and inner generally cylindrical walls 26, 27 are provided which are closed at their upper and lower ends by end walls 28, 29. An annular space 30 is defined between the walls and this forms the equivalent of the passage 22 shown in FIG. 1. Communicating with the annular space at its upper end, is the inlet 23 and the outlet 21 communicates with the annular space at its lower end. The wall 27 defines adjacent the inlet 23, the inlet 25 to the chamber 18 which is defined by the inner wall 27. At its lower end, the wall 27 defines the restricted outlet 20 adjacent the outlet 21. Conveniently the walls 26 and 27 are divided intermediate their ends and are formed by injection moulding techniques. The walls can be jointed using friction welding techniques or by means of suitable adhesive.

Figure 3:
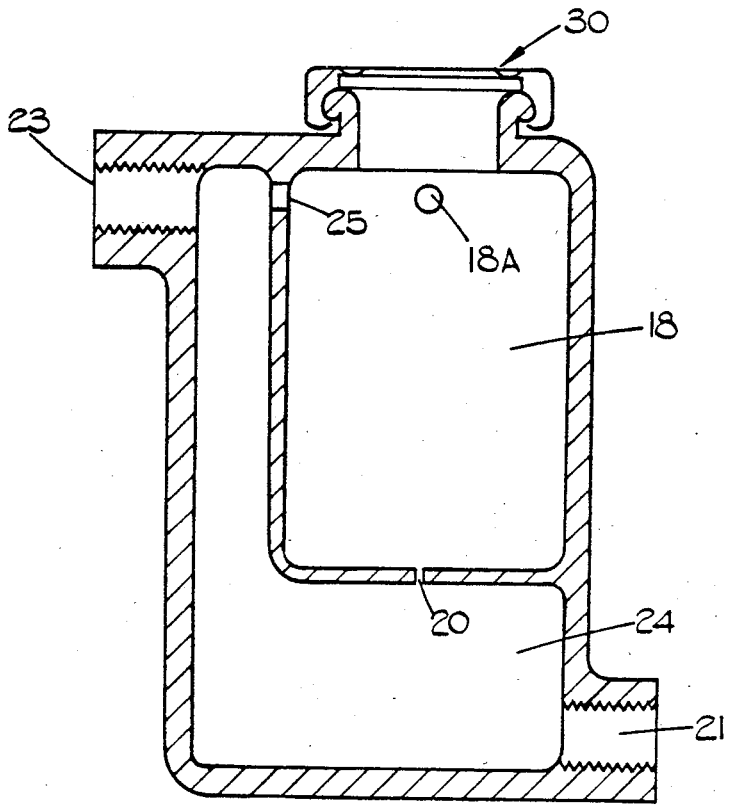
FIG. 3 shows another example of the same part.

FIG. 3 shows a further arrangement in which the first chamber 18 is provided in addition to the inlet opening 25, with a detachable cap 30 whereby the chamber can be filled with fuel when the fuel system is first assembled or when in use the fuel system has been completely drained of fuel. In the arrangement shown in FIG. 3, the second chamber 24 is defined in a portion of the same body which defines the chamber 18.

In each of the examples described the inlet 25 is positioned in the main fuel flow and its size is such in relation to the outlet 20, that the chamber 18 is filled gradually once the associated engine has started. In this way most of the fuel drawn by the pump from the tank flows to the inlet of the low pressure pump. The air in the chamber 18 is displaced gradually through the vent 18A as the chamber is filled. Since the outlet 20 is small it may be provided with a loose pin which in use will vibrate to prevent blockage of the outlet by any dirt. The provision of the chamber 24 is not essential and could be constituted by the volume of the pipe connecting the outlet 21 with the inlet of the pumping apparatus. In the event that the chamber 24 is omitted in the case where the construction shown in FIG. 2 is employed, the annular space 30 will perform the duty of the second chamber. It is however not so efficient since the fuel levels in the two chambers will only equalise so that a substantial portion of the fuel contained in the first chamber 18 cannot be used to assist the starting of the associated engine. It is found that in use whereas the chamber 18 becomes full of fuel the space 30 in the example of FIG. 2 or the equivalent in the other examples does not completely fill with fuel. The resulting volume of air in the upper portion of the space acts as a shock absorber to minimise the risk of damage to the lower pressure pump.

We claim:

1. A fuel system for an internal combustion engine comprising a fuel pumping apparatus incorporating high and low pressure pumps, a fuel filter unit through which fuel is drawn by the low pressure pump from a fuel supply tank, the fuel being supplied by the low pressure pump to the high pressure pump, a body defining inner and outer hollow cylindrical walls and end walls closing the upper and lower ends of said cylindrical walls, a fuel reservoir defined by the inner cylindrical wall, said fuel reservoir chamber being disposed in use, above the pumping apparatus and having a restricted outlet defined in said inner cylindrical wall adjacent the lower end thereof, said restricted outlet communicating with the annular space defined between said cylindrical walls, an outlet for connection to the pumping apparatus adjacent the lower end of said outer cylindrical wall to put said restricted outlet in communication with the inlet of the low pressure pump, and an inlet for connection to the fuel filter unit adjacent the upper end of said outer cylindrical wall and an inlet to the reservoir chamber adjacent the upper end of said inner cylindrical wall to maintain said chamber full of fuel during use of the apparatus.

2. A fuel system for an internal combustion engine comprising a fuel pumping apparatus incorporating high and low pressure pumps, a fuel filter unit through which fuel is drawn by the low pressure pump from a fuel supply tank, the fuel being supplied by the low pressure pump to the high pressure pump, a body defining first and second chambers, one of said chambers providing an interconnection between an inlet and an outlet on the body for connection respectively to the filter unit and the pumping apparatus, the other chamber defining a fuel reservoir chamber disposed in use, above the pumping apparatus, said other chamber having a restricted outlet communicating with said one chamber near the lower end thereof from which extends said outlet to put said restricted outlet in communication with the inlet of the low pressure pump, an inlet to said other chamber providing a communication between said chambers near the upper end thereof, and an inlet opening to the upper part of said other chamber and a detachable cap for said opening to maintain said fuel reservoir chamber full of fuel during use of the apparatus.

3. A fuel system for an internal combustion engine comprising a fuel pumping apparatus incorporating high and low pressure pumps, a fuel filter unit through which fuel is drawn by the low pressure pump from a fuel supply tank, the fuel being supplied by the low pressure pump to the high pressure pump, a fuel reservoir chamber disposed in use, above the pumping apparatus, said chamber having a restricted outlet in communication with the inlet of the low pressure pump and an air vent from the upper portion of said reservoir chamber, and means for maintaining said chamber full of fuel during use of the apparatus.

4. A fuel system for an internal combustion engine comprising a fuel pumping apparatus incorporating high and low pressure pumps, a fuel filter unit through which fuel is drawn by the low pressure pump from a fuel supply tank, the fuel being supplied by the low pressure pump to the high pressure pump, and a passage connecting said filter unit with the inlet of the low pressure pump, and an engine restarting fuel supply means for supplying fuel to said low pressure pump during an engine restarting procedure after the engine has stopped, said engine restarting means including a fuel reservoir chamber having an inlet connected to said passage and a restricted outlet connected to said passage at a location closer to said low pressure pump than said inlet to put said restricted outlet in communication with the inlet of the low pressure pump for maintaining said fuel reservoir chamber full of fuel during engine operation, said passage bypassing said fuel reservoir chamber, said restricted outlet being sized to supply fuel to said passage at a rate which causes the combustion engine to stall before all of the fuel stored in said fuel reservoir chamber is exhausted, a fuel storage means connected between said passage and said low pressure pump to be in fluid series therewith, said fuel reservoir chamber being located in use above the pumping apparatus and said fuel storage means having an inlet positioned so that gravity will cause fuel to flow into said fuel storage means from said passage after the engine has stopped, whereby the engine will stall if fuel is supplied only from said fuel reservoir chamber via said restricted outlet but will be restarted using fuel which has moved into said fuel storage means under gravity flow after the engine has stopped.

5. A fuel system according to claim 1 in which said cylindrical walls and said end walls are formed as a two part moulding.

* * * * *